US007036665B1

(12) United States Patent
Gyr

(10) Patent No.: US 7,036,665 B1
(45) Date of Patent: May 2, 2006

(54) BOOK LIKE PACKAGE

(76) Inventor: John D. Gyr, P.O. Box 232, Benzonia, MI (US) 49616

( * ) Notice: Subject to any disclaimer, the term of this patent is extended or adjusted under 35 U.S.C. 154(b) by 0 days.

(21) Appl. No.: 10/995,449

(22) Filed: Nov. 23, 2004

Related U.S. Application Data

(63) Continuation-in-part of application No. 10/687,021, filed on Oct. 17, 2003, now abandoned.

(51) Int. Cl.
*B65D 73/00* (2006.01)

(52) U.S. Cl. ..... 206/472; 206/497

(58) Field of Classification Search ..... 206/472–475, 206/232, 497

See application file for complete search history.

(56) References Cited

U.S. PATENT DOCUMENTS

| | | | | |
|---|---|---|---|---|
| 1,709,685 | A * | 4/1929 | Rothrock | 206/472 |
| 1,729,518 | A | 9/1929 | Newman | |
| 2,341,600 | A * | 2/1944 | Daniel | 206/472 |
| 2,874,707 | A * | 2/1959 | Koppel | 206/472 |
| 3,755,925 | A * | 9/1973 | Court | 206/232 |
| 3,835,987 | A | 9/1974 | Growney | |
| 5,209,349 | A * | 5/1993 | Porter et al. | 206/232 |
| 5,248,037 | A | 9/1993 | Kronberg et al. | |
| 5,251,747 | A | 10/1993 | Hansen et al. | |
| 5,375,718 | A | 12/1994 | Honma et al. | |
| 6,241,084 | B1 | 6/2001 | Gyr | |

* cited by examiner

*Primary Examiner*—Luan K. Bui
(74) *Attorney, Agent, or Firm*—Charles M. Kaplan

(57) ABSTRACT

A package that resembles a book employs a box into which a wide variety of different types of products can be stored. The box is enclosed in a sturdy overlay that has panels that resemble the front and back covers and spine of a book. The cover and spine panels are textured and imprinted so that the package resembles a book.

22 Claims, 11 Drawing Sheets

BOOK LIKE PACKAGE

This application is a Continuation In Part of application Ser. No. 10/687,021 which was filed on Oct. 17, 2003, now abandoned the benefit of which is hereby claimed.

BACKGROUND OF THE INVENTION

This invention relates to packages that can be used to merchandise a wide variety of different kinds of products, and more particularly to packages that resemble books. The use of prior packages that resemble books has been limited to a specific product or product category, such as clothing.

OBJECTIVES OF THE INVENTION

Accordingly, it is an object of this invention to provide improved packages that resemble books.

Another object is to provide book resembling packages that can be used to merchandise a wide variety of different types of products.

An additional object is to provide book-like packages that protect fragile products from damage.

Another object is to provide packages that look like books that can be used to distribute solid, liquid, edible, breakable and valuable products.

A further object is to provide versatile book resembling packages that are durable, secure and protective of their contents, economical to manufacture and distribute, highly attractive, easy to handle, ship and display, and which do not possess defects found in prior art book-like packages.

Other objects and advantages of the packages incorporating this invention will be found in the specification and claims and the scope of the invention will be set forth in the claims.

DESCRIPTION OF THE INVENTION

Figure 1:
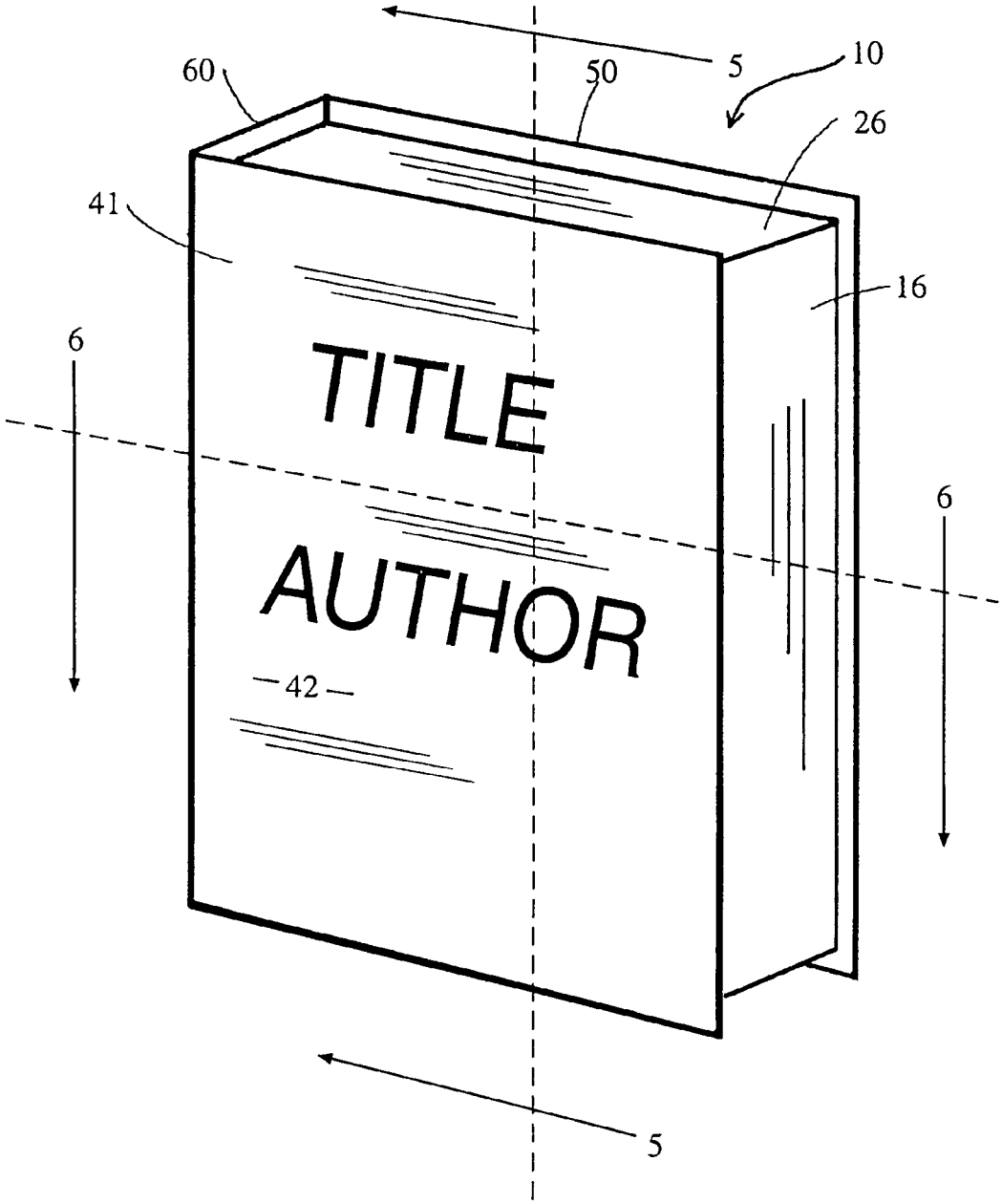
FIG. 1 is a schematic perspective view of an embodiment of a book package in accord with this invention in closed position.
Figure 2:
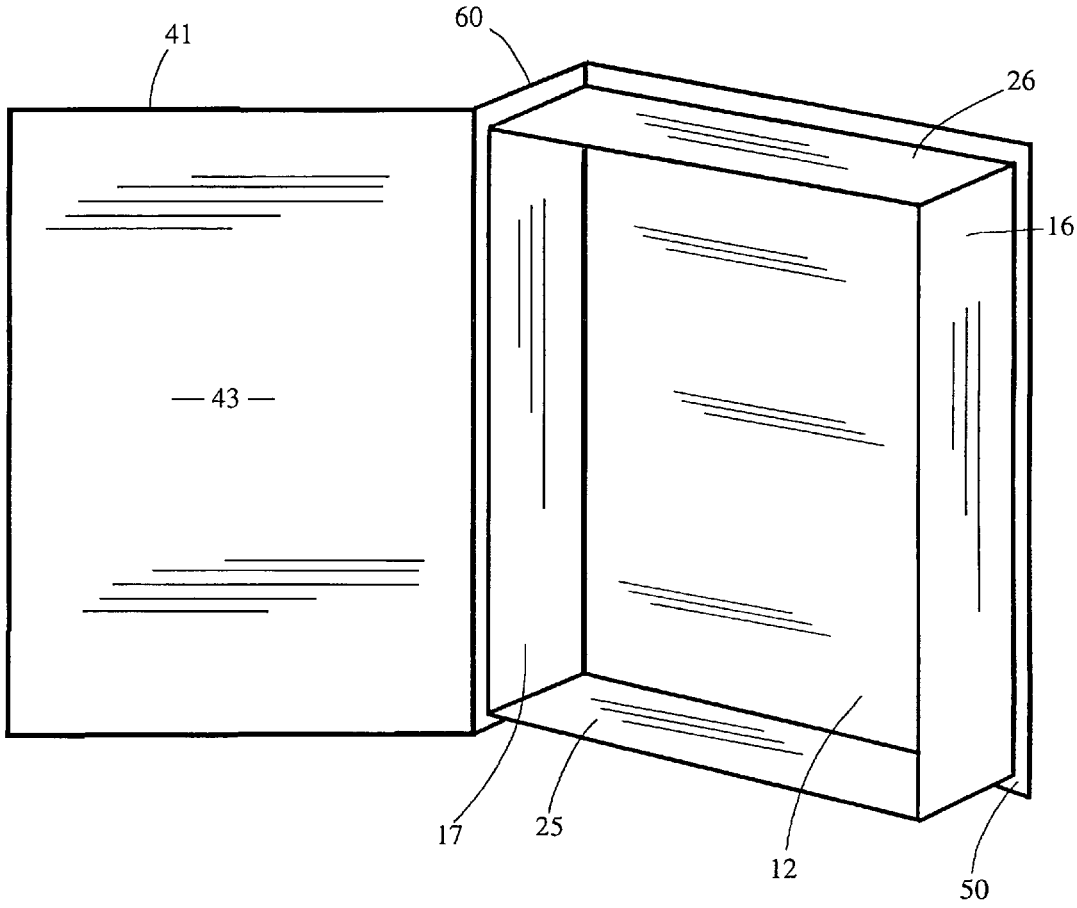
FIG. 2 shows the book package of FIG. 1 in open position.
Figure 3:
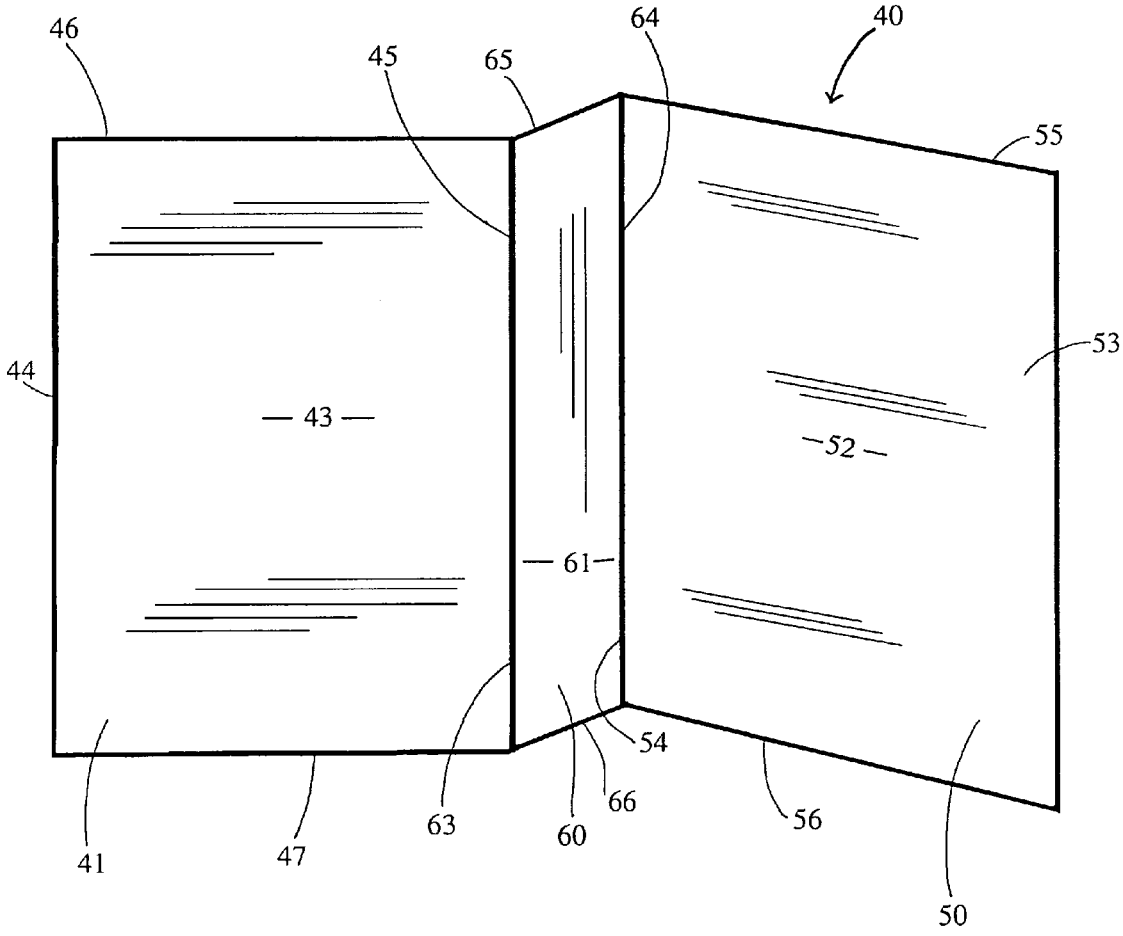
FIG. 3 is a schematic perspective view of the closure member from the embodiment of FIG. 1.
Figure 4:
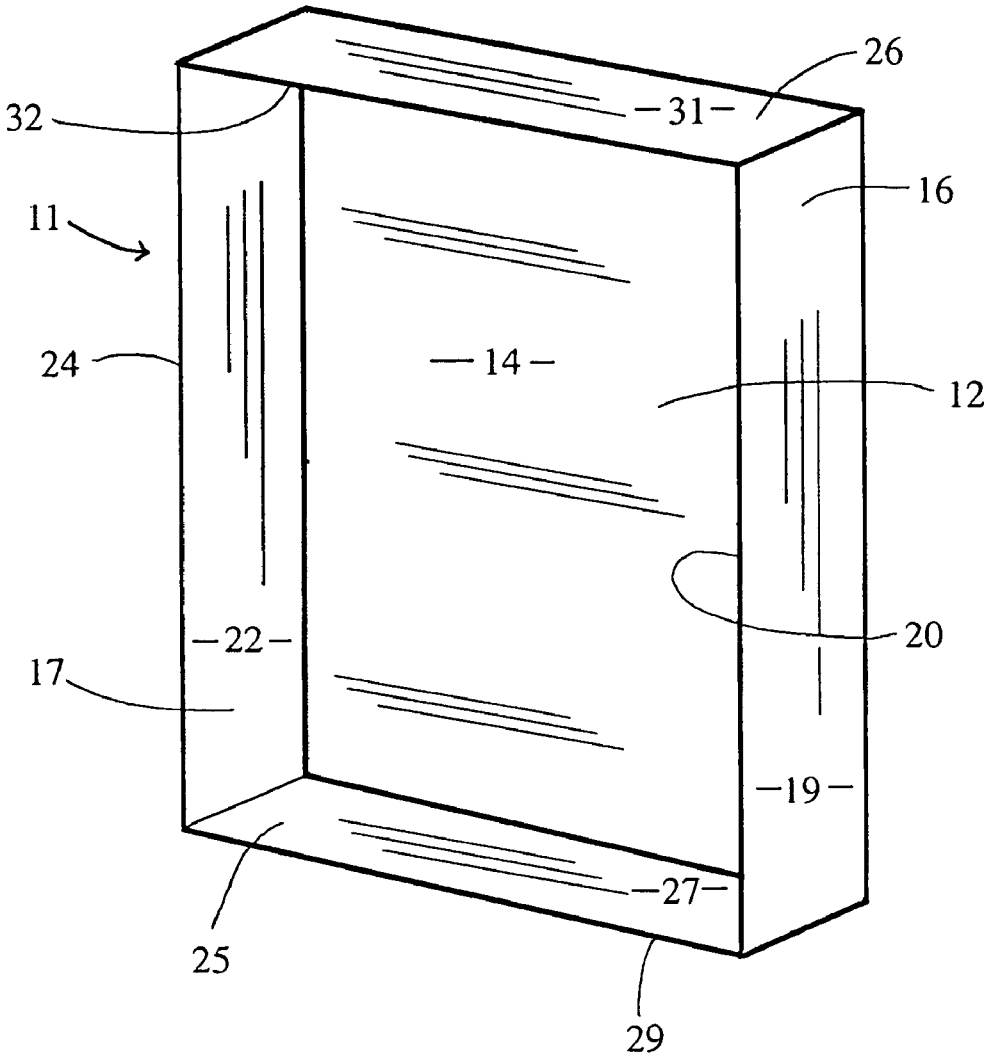
FIG. 4 is a schematic perspective view of the box from the embodiment of FIG. 1.
Figure 5:
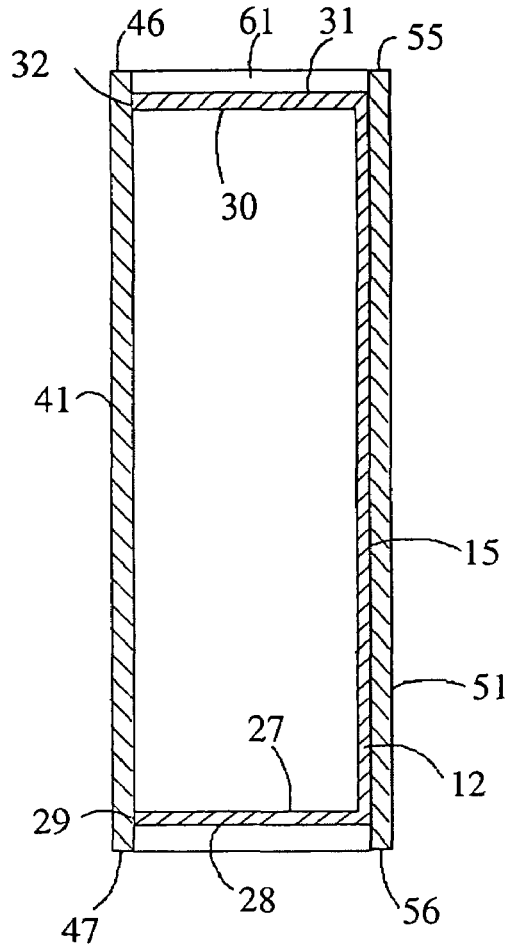
FIG. 5 is a cross sectional view taken along the line 5—5 in FIG. 1.
Figure 6:
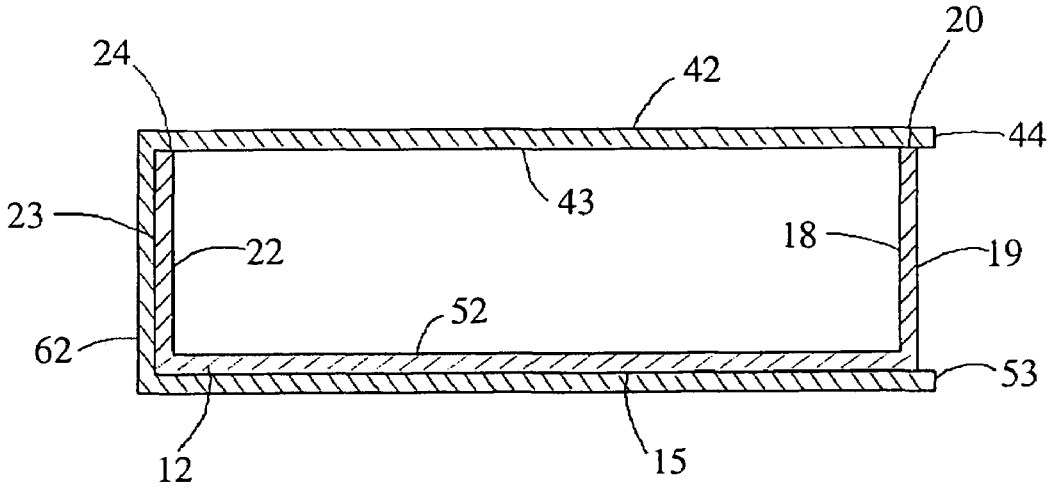
FIG. 6 is a cross sectional view taken along the line 6—6 in FIG. 1.

The drawing shows a package 10 that resembles a closed rectangular book. In FIG. 1 the package 10 is shown in closed position, and in FIG. 2 the package is shown open and empty. Products or merchandise in the package 10 may be contained in an integral, sturdy, open ended rectangular box 11 that can be removed from the package and used for storage or display of its contents after the package has been opened. The box 11 may be made from durable material such as soft or hard plastic, metal, wood, fiberboard, cardboard, stiff paper or ceramic, and may be lined with soft plastic, fabric, velvet, metal foil, shredded paper, confetti and the like to protect its contents and enhance their display.

The box has a flat bottom 12 that has a flat inner surface 14 and a flat outer surface 15. A pair of identical side walls 16 and 17 extend perpendicularly from opposite side edges of the inside surface of bottom 12. The side wall 16 has a flat inner surface 18, a flat outer surface 19, and terminates in a flat outer edge 20. The side wall 17 has a flat inner surface 22, a flat outer surface 23, and terminates in a flat outer edge 24. A pair of identical end walls 25 and 26 extend perpendicularly form opposite end edges of the inside surface of the bottom 12. End wall 25 has a flat inner surface 27, a flat outer surface 28 and a terminates in a flat outer edge 29. End wall 26 has a flat inner surface 30, a flat outer surface 31 and terminates in a flat outer edge 32. The adjacent surfaces of side wall 16 and end walls 25 and 26, and of side wall 17 and end walls 25 and 26 are joined to each other so that their flat inner surfaces 18, 22, 27 and 30 define an open ended rectangular space within the box 11.

The package 10 and box 11 may be closed by a removable, integral, sturdy, rectangular protective cover or closure member 40 that gives the package the appearance of a book. Closure cover 40 may be made from stiff paper, cardboard, plastic or other durable material that can be textured and imprinted to resemble the cover and spine of a book.

Closure 40 has a flat rectangular front panel 41 that may have a flat outside surface 42 and a flat inside surface 43. Front panel 41 has opposite side edges 44 and 45 and opposite end edges 46 and 47. The outside surface 42 of the front panel is decorated and imprinted so that it resembles the front cover of a book. Closure member 40 has a flat rectangular back panel 50 that may have a flat outside surface 51 and a flat inside surface 52. The back panel 50 has opposite side edges 53 and 54 and opposite end edges 55 and 56. The outside surface 51 of the back panel is decorated and imprinted so that it resembles the back cover of a book. Closure member 40 has a flat rectangular spine panel 60 that has a flat inside surface 61 and may have a flat outside surface 62. Spine panel 60 has opposite side edges 63 and 64 and opposite end edges 65 and 66. The outside surface 62 of spine panel 60 is decorated and imprinted so that it resembles the spine of a book. The side edge 45 of the front panel is integral with side edge 63 of the spine panel. The other side edge 44 of the front panel is unattached and is pivotally movable toward and away from the box 11 and back panel 50. The side edge 54 of the back panel is integral with the side edge 64 of the spine panel. The side edge 53 of said back panel is unattached.

When the package 10 is in its closed position, the closure member 40 closes the box 11. The flat inside surface 43 of the front panel 41 contacts the flat outer edges 20, 24, 29 and 32 of the end walls and side walls of the box. The flat outside surface 23 of the box side wall 17 contacts the flat inside surface 61 of the spine panel. The flat outside surface of the box bottom 15 contacts the flat inside surface 52 of the back panel.

The end edge 46 of the front panel 41, the end edge 55 of the back panel 50 and the end edge 65 of the spine panel 60 all extend beyond and terminate past the end wall 26 of the box. The end edge 47 of the front panel 41, the end edge 56 of the back panel 50 and the end edge 66 of the spine panel 60 all extend beyond and terminate past the end wall 25 of the box. The unattached end edge 44 of the front panel 41 and the unattached end edge 53 of the back panel 50 extend beyond and terminate past the side wall 16 of the box.

Figure 7:
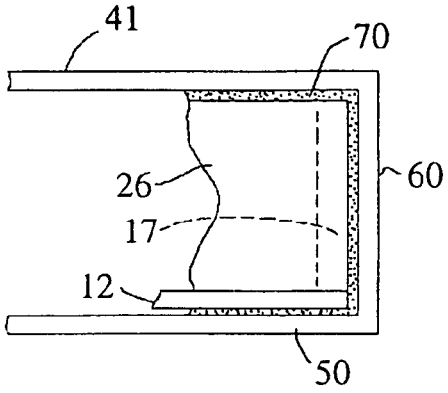
FIG. 7 is a schematic fragmentary side view showing an embodiment of sealing means.

Suitable means are provided for sealing the package 10 and holding the box 11 and the product contained in the box inside of the closure member 40. As shown in FIG. 7, a waterproof glue 70 may be applied to some or all of the surfaces of the closure member 40 and box 11 that contact each other so as to bond the closure member to the box. The glue 70 could be used to bond the flat outer surface 23 of side wall 17 of the box to the flat inside surface 61 of the spine panel 60. The glue 70 could also be used to bond the flat outer surface 15 of the bottom 12 of the box to the flat inside surface 52 of the back panel 50. The glue 70 could also be used to bond the flat inside surface 43 of the front panel 41 to the flat outer edges of 20 and 20 of the box side walls and the flat outer edges 29 and 32 of the box end walls.

Figure 8:
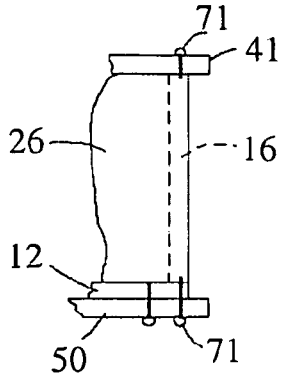
FIG. 8 is a schematic fragmentary side view showing another embodiment of sealing means.
Figure 9:
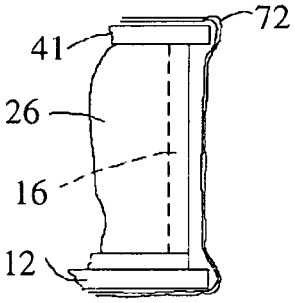
FIG. 9 is a schematic fragmentary side view showing another embodiment of sealing means.

In FIG. 8 the means for sealing the package 10 and holding the box 11 and product inside of the closure member 40 may be removable fasteners 71 such as screws, nails or staples that extend through the closure member into the walls 16, 17, 25 and 26 and bottom 12 of the box. In FIG. 9, the means for sealing the package 10 and holding the box 11 and product inside of the closure member 40 may be an opaque, translucent or transparent plastic film or membrane 72 that completely envelops the package 10 and is shrink wrapped to seal around the closure member and the box. Descriptive or pictorial material may be printed on the film 72.

Figure 10:
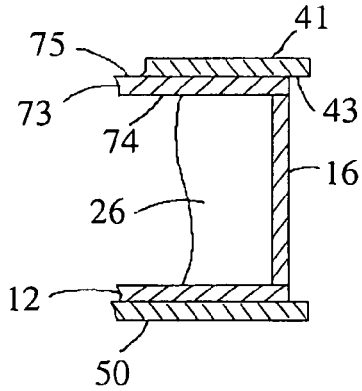
FIG. 10 is a schematic fragmentary cross sectional view showing another embodiment of the invention.

FIG. 10 shows another embodiment of the invention that is identical to the embodiments of FIGS. 1–9 except that the box 11 has a lid 73 that closes the open end of the box. The lid 73 has a flat inner surface 74 and a flat outer surface 75. The flat inside surface 43 of the front panel 41 contacts the flat outer surface of the lid when the package 10 is in its closed position.

Figure 11:
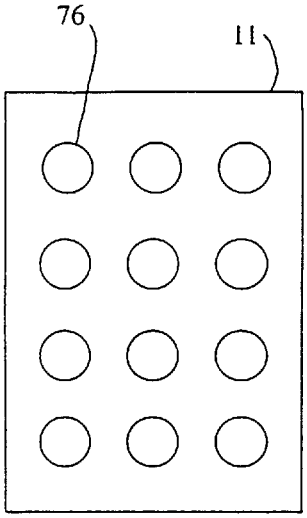
FIG. 11 is a schematic side view on a reduced scale of a box from the FIG. 1 embodiment showing one type of packaged product.
Figure 12:
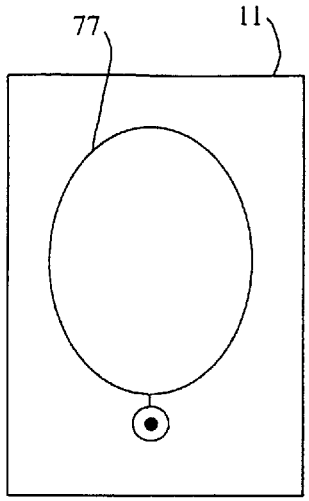
FIG. 12 is a schematic side view on a reduced scale of a box from the FIG. 1 embodiment showing another type of packaged product.
Figure 13:
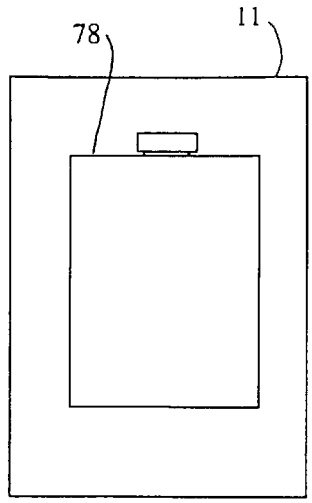
FIG. 13 is a schematic side view on a reduced scale of a box from the FIG. 1 embodiment showing another type of packaged product.
Figure 14:
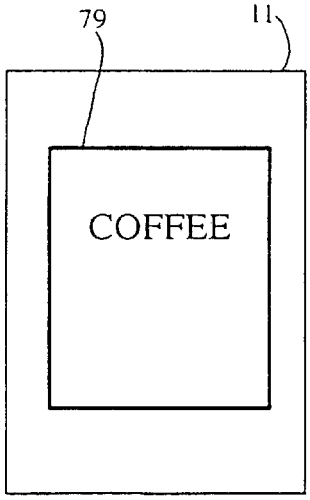
FIG. 14 is a schematic side view on a reduced scale of a box from the FIG. 1 embodiment showing another type of packaged product.
Figure 15:
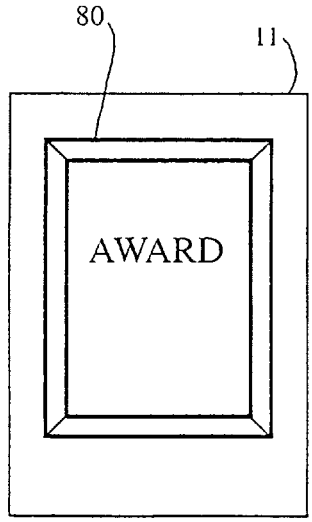
FIG. 15 is a schematic side view on a reduced scale of a box from the FIG. 1 embodiment showing another type of packaged product.
Figure 16:
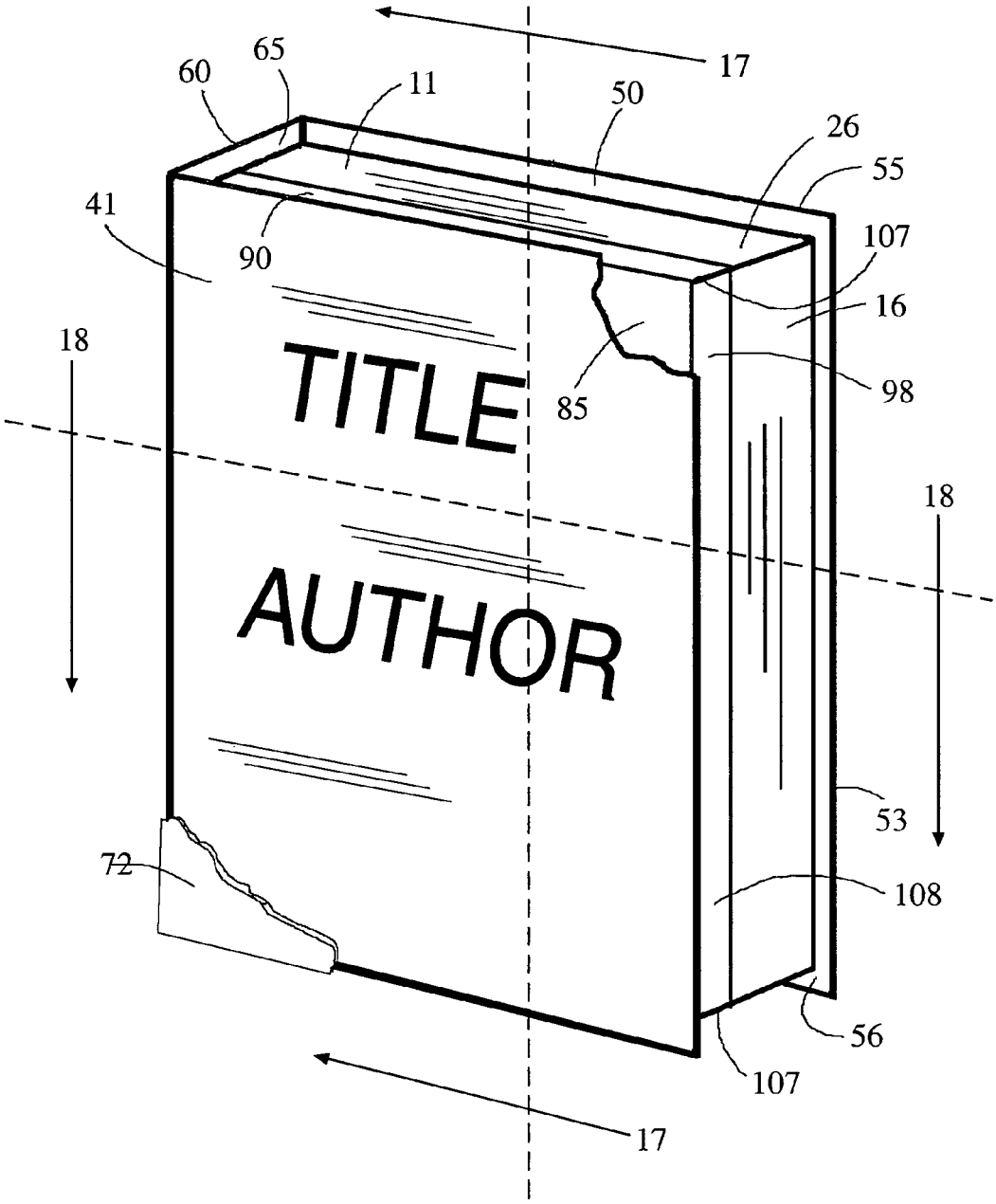
FIG. 16 is a schematic, partially broken away, perspective view of another embodiment of a book package in accord with this invention in closed position.

FIGS. 11–15 illustrate the wide variety of products that can fit into a box 11 and can be safely and effectively merchandised in the package 10, and then stored or displayed in the box 11 during further use after the package has been opened. FIG. 11 shows that bonbons 76 or other delicate candy treats may be stored in a box 11. FIG. 12 shows that a necklace 77 or other valuable jewelry may be stored in a box 11. FIG. 13 shows that a capped plastic or glass container 78 containing a liquid such as wine, seasoned vinegar, shampoo, or hand lotion may be stored in a box 11. FIG. 14 shows that coffee beans or grounds 79 or other food products may be stored in a box 11. FIG. 15 shows that a framed award 80 or other printed certificate may be stored in a box 11.

FIGS. 16–22 illustrate embodiments of the invention in which it is advantageous to close the box 11 with a removable lid 85. The references numerals previously used are repeated to designate the same components of the invention shown in FIGS. 16–22. Lid 85 may include an essentially rectangular end panel 86 having a flat inner surface 87 opposed to a flat outer surface 88. The flat inside surface 43 of the front panel 41 may contact the flat outer surface 88 of lid 85 when the package is closed. A first pair of ledges 89 and go, respectively, each have attached ends 91 and 92 that are integral with the flat panel 86. The first pair of ledges 89 and go, respectively, each have an opposite unattached free end 93 and 94. The first pair of ledges 89 and go extend essentially perpendicularly to the flat inner surface 87 of the end panel 86 from opposite ends 95 and 96 of the panel. A second pair of ledges 98 and 99, respectively, each have attached ends 100 and 101 that are integral with the flat panel 86. The second pair of ledges 98 and 99, respectively, each have an opposite unattached free end 102 and 104. The second pair of ledges 98 and 99 extend essentially perpendicularly to the flat inner surface 87 of the end panel 86 from opposite sides 105 and 106 of the panel. Adjacent ends of said first pair of ledges and said second pair of ledges are connected to each other at joints 107 so as to define a continuous, rectangular, peripheral rim 108 around the open end of box 11. Portions of the rim 108 are in frictional engagement with the outer surface of the end walls 25 and 26 and the side walls of the box 11 so as to removably hold lid 85 on the box and thereby to hold the contained product in the box.

Figure 17:
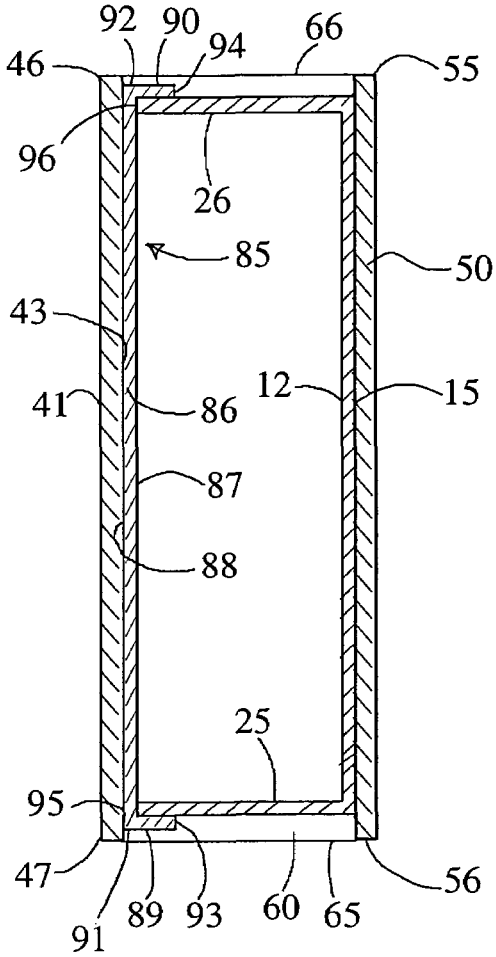
FIG. 17 is a cross sectional view taken along the line 17—17 in FIG. 16.
Figure 18:
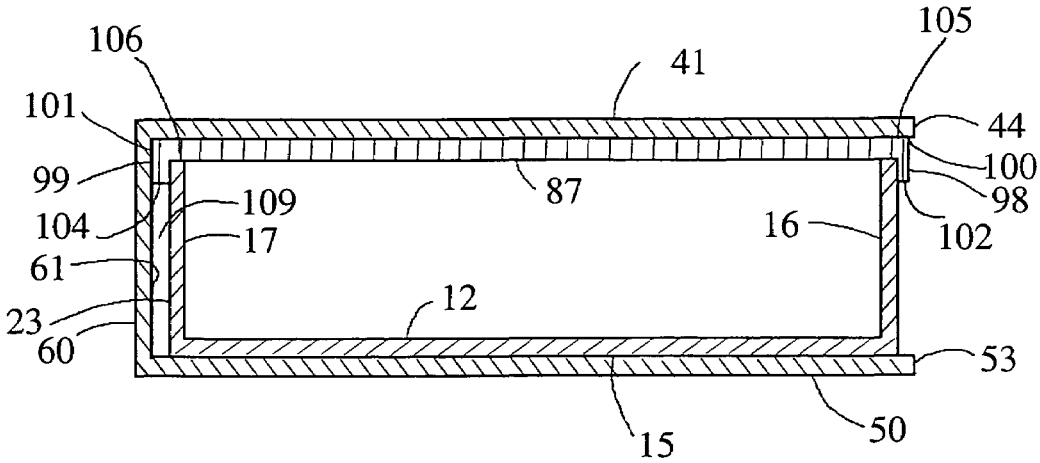
FIG. 18 is a cross sectional view taken along the line 18—18 in FIG. 16.
Figure 19:
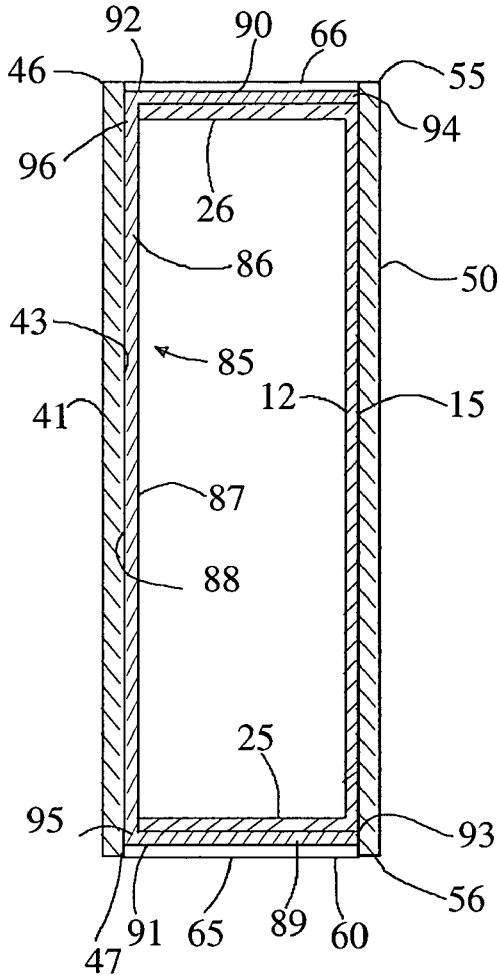
FIG. 19 is a cross sectional view corresponding to FIG. 16 showing another embodiment of the invention.
Figure 20:
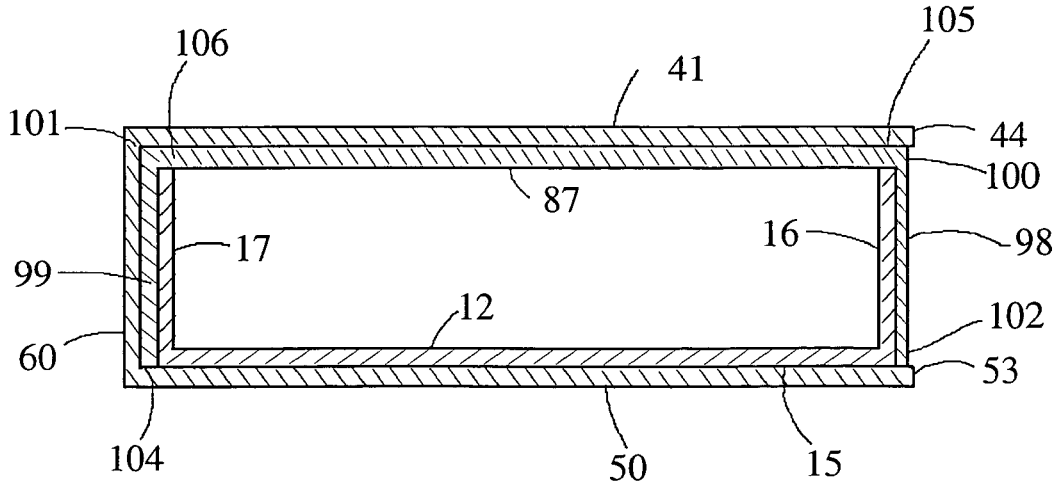
FIG. 20 is a cross sectional view corresponding to FIG. 17 showing the same embodiment as FIG. 19.
Figure 21:
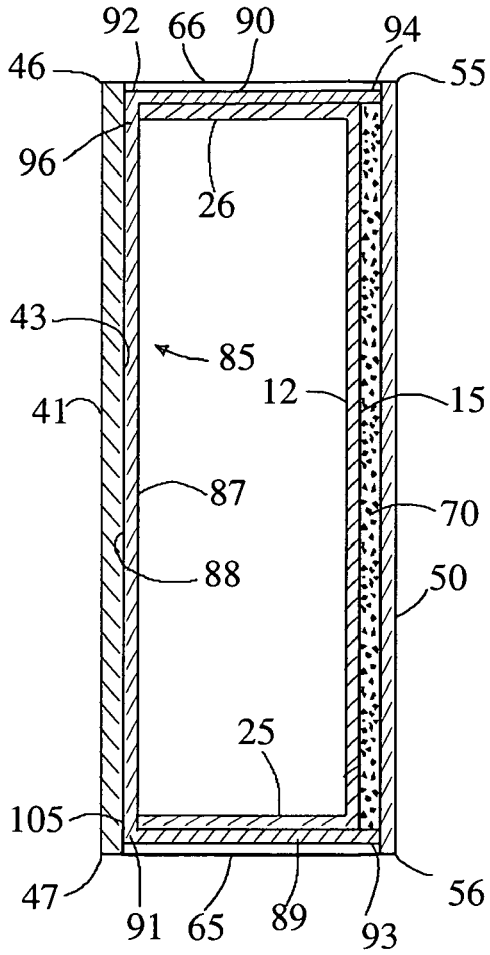
FIG. 21 is a cross sectional view corresponding to FIG. 16 showing another embodiment of the invention.
Figure 22:
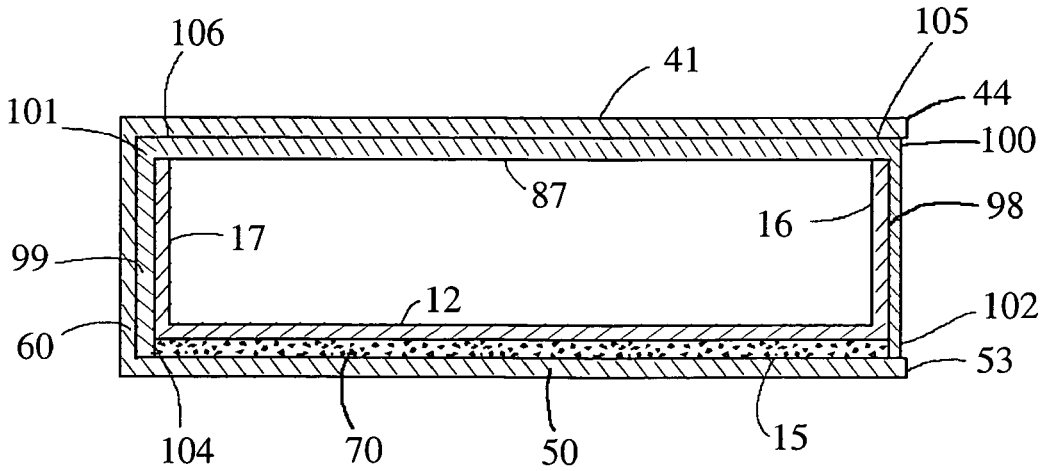
FIG. 22 is a cross sectional view corresponding to FIG. 17 showing the same embodiment as FIG. 21.

As shown in FIGS. 17 and 18, the unattached free ends 93 and 94 of the first pair of ledges 89 and go, and the unattached free ends 102 and 104 of the second pair of ledges 98 and 99 terminate short of the flat outer surface 15 of the bottom 12 of box 11. Part of the inside surface 61 of the spine 60 may rest against the second ledge 99 when the package is closed leaving a space 109 between the remainder of the surface 61 and the outer surface 23 of the box side wall 17. As shown in FIGS. 19 and 20, the unattached free ends 93 and 94 of the first pair of ledges 89 and go and the unattached free ends 102 and 104 of the second pair of ledges 98 and 99 terminate adjacent or even with the flat outer surface 15 of the bottom 12 of box 11. As shown in FIGS. 21 and 22, the unattached free ends 93 and 94 of the first pair of ledges 89 and go and the unattached free ends 102 and 104 of the second pair of ledges 98 and 99 extend beyond the flat outer surface 15 of the bottom 12 of box 11.

As shown in FIGS. 16–22, the end edges 46 and 47 of the front panel 41, and the end edges 55 and 56 of the back panel 50, and the end edges 65 and 66 of the spine panel 60 all terminate beyond the ledges 89 and go of the lid 85. The unattached edge 44 of the front panel 41, and the unattached edge 53 of the back panel 50 and the edges 65 and 66 of the spine panel 60 terminate beyond the outside surfaces of the lid 85.

The lid 85 may be made from durable material such as soft or hard plastic, metal, wood, fiberboard, cardboard, stiff paper or ceramic. The lid 85 may be opaque, translucent or transparent. Descriptive or pictorial material may be printed on the lid 85. The box 11 may be centered in closure cover 40 so that the inside surface 61 of the spine panel does not contact the lid 85 or the box 11. Glue 70 may be used to bond the bottom 15 of the box to the back panel 50.

While the present invention has been described with reference to particular embodiments, it is not intended to illustrate or describe all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

I claim:

1. A package resembling a book, comprising:

an open ended box having a bottom that has an inner surface and a flat outer surface, a pair of identical side walls extending away from opposite side edges of the inner surface of said bottom, each of said side walls having an inner surface and an outer surface, a pair of identical end walls extending away from opposite end edges of the inner surface of said bottom, each of said end walls having an inner surface and an outer surface, adjacent end and side walls being connected to each other so that their inner surfaces define a space for containing a product within said box;

a product contained within said space within said box;

a closure member for said box comprising a front panel having an outside surface and a flat inside surface, said front panel having opposite side edges and opposite end edges, said outside surface of said front panel resembling a front cover of a book, a back panel having an outside surface and a flat inside surface, said back panel having opposite side edges and opposite end edges, said outside surface of said back panel resembling a back cover of a book, and a spine panel having a flat inside surface and an outside surface, said spine panel having opposite side edges and opposite end edges, said outside surface of said spine panel resembling the spine of a book, one side edge of said front panel being attached to one side edge of said spine panel, the other side edge of said front panel being unattached, one side edge of said back panel being attached to the side edge of said spine panel opposite to said one edge of said spine panel, and the other side edge of said back panel being unattached;

the flat outer surface of said bottom of said box contacting said flat inside surface of said back panel;

an unattached removable lid closing the open end of said box, said lid having a flat outer surface, and said flat inside surface of said front panel contacting said flat outer surface of said lid, and means holding said box and said product in said box in said closure member.

2. The package resembling a book defined in claim 1, wherein said lid comprises an essentially rectangular end panel having a flat inner surface opposed to said flat outer surface, a first pair of ledges each having an attached end integral with said end panel and an opposite unattached free end, said first pair of ledges extending essentially perpendicularly to said flat inner surface of said end panel from opposite ends of said end panel, a second pair of ledges each having an attached end integral with said end panel and an opposite unattached free end, said second pair of ledges extending essentially perpendicularly to said flat inner surface of said end panel from opposite sides of said end panel, adjacent ends of said first pair of ledges and said second pair of ledges being connected to each other so as to define a peripheral rim around the open end of said box, and portions of said rim being in frictional engagement with said outer surface of said end walls and said side walls of said box so as to removably hold said lid on said box and thereby to hold said product in said box.

3. The package resembling a book defined in claim 1, wherein said means holding said box and said product in said closure member comprises a transparent plastic membrane sealing around said closure member and said box.

4. The package resembling a book defined in claim 2, wherein the unattached free ends of said first and second pairs of ledges terminating short of said flat outer surface of said bottom of said box.

5. The package resembling a book defined in claim 2, wherein the unattached free ends of said first and second pairs of ledges terminating adjacent said flat outer surface said bottom of said box.

6. The package resembling a book defined in claim 2, wherein said lid being transparent and the unattached free ends of said first and second pairs of ledges terminating short of said flat outer surface of said bottom of said box; and said means holding said box in said closure member comprising and glue bonding the flat outer surface of said bottom of said box to said flat inside surface of said back panel, and a plastic membrane sealing around said closure member and said box.

7. The package resembling a book defined in claim 2, wherein the unattached free ends of said first and second pairs of ledges of said lid terminating adjacent said flat outer surface said bottom of said box; and said means holding said box in said closure member comprising glue bonding the flat outer surface of said bottom of said box to said flat inside surface of said back panel, and a plastic membrane sealing around said closure member and said box.

8. A package that resembles a rectangular book, comprising:

an open ended rectangular box having a flat bottom having an inner surface and a flat outer surface, a pair of identical side walls extending perpendicularly from opposite side edges of the inside surface of said bottom, each of said side walls having an inner surface and a flat outer surface, a pair of identical end walls extending perpendicularly from opposite end edges of the inside surface of said bottom, each of said end walls having an inner surface and a flat outer surface, adjacent end and side walls being connected to each other so that their inner surfaces define an open ended rectangular space within said box;

a product contained within said rectangular space;

a rectangular closure member for said box comprising a rectangular front panel having an outside surface and a flat inside surface, said front panel having opposite side edges and opposite end edges, said outside surface of said front panel resembling a front cover of a book, a rectangular back panel having an outside surface and a flat inside surface, said back panel having opposite side edges and opposite end edges, said outside surface of said back panel resembling a back cover of a book, and a rectangular spine panel having a flat inside surface and an outside surface, said spine panel having opposite side edges and opposite end edges, said outside surface of said spine panel resembling the spine of a book, one side edge of said front panel being attached to one side edge of said spine panel, the other side edge of said front panel being unattached and movable toward and away from said back panel, and one side edge of said back panel being attached to the side edge of said spine panel that is opposite to said one edge of said spine panel, and the other side edge of said back panel being unattached;

the flat outer surface of said bottom of said box contacting said flat inside surface of said back panel;

the end edges of said front panel and the end edges of said back panel and the end edges of said spine panel all terminating beyond the end walls of said box, the unattached edge of said front panel and the unattached edge of said back panel terminating beyond the side walls of said box;

an unattached removable rectangular lid closing the rectangular open end of said box;

and means holding said box and said product in said box in said closure member.

9. The package resembling a book defined in claim 8, wherein said unattached removable rectangular lid comprises an essentially rectangular end panel having a flat inner surface and a flat outer surface, a first pair of ledges each having an attached end integral with said end panel and an opposite unattached free end, said first pair of ledges extending essentially perpendicularly to said flat inner surface of said end panel from opposite ends of said end panel, a second pair of ledges each having an attached end integral with said end panel and an opposite unattached free end, said second pair of ledges extending essentially perpendicularly to said flat inner surface of said end panel from opposite sides end of said end panel, adjacent ends of said first pair of ledges and said second pair of ledges being connected to each other so as to define a peripheral rim around the open end of said box, and portions of said rim being in frictional engagement with said outer surface of said end walls and said side walls of said box so as to removably hold said lid on said box and thereby to hold said product in said box.

10. The package that resembles a rectangular book defined in claim 8, wherein said means holding said box and said product in said closure member comprises a plastic membrane sealing around said closure member and said box.

11. The package resembling a book defined in claim 9, wherein the unattached free ends of said first and second pairs of ledges terminating short of said flat outer surface of said bottom of said box.

12. The package resembling a book defined in claim 9, wherein the unattached free ends of said first and second pairs of ledges terminating adjacent said flat outer surface said bottom of said box.

13. The package resembling a book defined in claim 9, wherein said lid being transparent and the unattached free ends of said first and second pairs of ledges terminating short of said flat outer surface of said bottom of said box; and said means holding said box in said closure member comprising and glue bonding the flat outer surface of said bottom of said box to said flat inside surface of said back panel, and a plastic membrane sealing around said closure member and said box.

14. The package resembling a book defined in claim 9, wherein the unattached free ends of said first and second pairs of ledges of said lid terminating adjacent said flat outer surface said bottom of said box; and said means holding said box in said closure member comprising glue bonding the flat outer surface of said bottom of said box to said flat inside surface of said back panel, and a plastic membrane sealing around said closure member and said box.

15. A package resembling a book, comprising:

a rectangular open ended box having a bottom that has an inner surface and a flat outer surface, a pair of identical side walls extending away from opposite side edges of the inner surface of said bottom, each of said side walls having an inner surface and an outer surface, a pair of identical end walls extending away from opposite end edges of the inner surface of said bottom, each of said end walls having an inner surface and an outer surface, adjacent end and side walls being connected to each other so that their inner surfaces define an open ended rectangular space for containing a product within said box;

a product contained within said rectangular space within said rectangular box;

a closure member for said box comprising a front panel having an outside surface and a flat inside surface, said front panel having opposite side edges and opposite end edges, said outside surface of said front panel resembling a front cover of a book, a back panel having an outside surface and a flat inside surface, said back panel having opposite side edges and opposite end edges, said outside surface of said back panel resembling a back cover of a book, and a spine panel having a flat inside surface and an outside surface, said spine panel having opposite side edges and opposite end edges, said outside surface of said spine panel resembling the spine of a book, one side edge of said front panel being attached to one side edge of said spine panel, the other side edge of said front panel being unattached, one side edge of said back panel being attached to the side edge of said spine panel opposite to said one edge of said spine panel, and the other side edge of said back panel being unattached;

a removable rectangular lid for closing said open ended rectangular space, said lid comprising an essentially rectangular end panel having a flat inner surface and a flat outer surface, a first pair of ledges each having an attached end integral with said end panel and an opposite unattached free end, said first pair of ledges extending essentially perpendicularly to said flat inner surface of said end panel from opposite ends of said end panel, a second pair of ledges each having an attached end integral with said end panel and an opposite unattached free end, said second pair of ledges extending essentially perpendicularly to said flat inner surface of said end panel from opposite sides of said end panel, adjacent ends of said first pair of ledges and said second pair of ledges being connected to each other so as to define a peripheral rim around the open end of said box, and portions of said rim being in frictional engagement with said outer surface of said end walls and said side walls of said box so as to hold said lid on said box and thereby to hold said product in said box; and means holding said box in said closure member.

16. The package resembling a book defined in claim 15, wherein said flat inside surface of said front panel contacts said flat outer surface of said lid.

17. The package resembling a book defined in claim 15, wherein the unattached free ends of said first and second pairs of ledges terminating short of said flat outer surface of said bottom of said box.

18. The package resembling a book defined in claim 15, wherein the unattached free ends of said first and second pairs of ledges terminating adjacent said flat outer surface said bottom of said box.

19. The package resembling a book defined in claim 15, wherein the unattached free ends of said first and second pairs of ledges extending beyond said flat outer surface of said bottom of said box.

20. The package resembling a book defined in claim 15, wherein the end edges of said front panel and the end edges of said back panel and the end edges of said spine panel all terminate beyond the ledges of said lid, and the unattached edge of said front panel and the unattached edge of said back panel and edges of said spine panel terminate beyond outside surfaces of said lid.

21. The package resembling a book defined in claim 15, wherein said lid being transparent and the unattached free ends of said first and second pairs of ledges terminating short of said flat outer surface of said bottom of said box; and said means holding said box in said closure member comprising and glue bonding the flat outer surface of said bottom of said box to said flat inside surface of said back panel, and a plastic membrane sealing around said closure member and said box.

22. The package resembling a book defined in claim 15, wherein the unattached free ends of said first and second pairs of ledges of said lid terminating adjacent said flat outer surface said bottom of said box; and said means holding said box in said closure member comprising glue bonding the flat outer surface of said bottom of said box to said flat inside surface of said back panel, and a plastic membrane sealing around said closure member and said box.

* * * * *